US005940981A

United States Patent [19]

Chau-Huu et al.

[11] Patent Number: 5,940,981

[45] Date of Patent: Aug. 24, 1999

[54] MACHINE FOR MANUFACTURING A MATERIAL SHEET

[75] Inventors: Tri Chau-Huu; Albrecht Meinecke; Josef Müllner, all of Heidenheim, Germany

[73] Assignee: Voith Sulzer Papiermaschinen GmbH, Heidenheim, Germany

[21] Appl. No.: 08/943,139

[22] Filed: Oct. 3, 1997

[30] Foreign Application Priority Data

Oct. 9, 1996 [DE] Germany ..... 196 41 599

[51] Int. Cl.[6] ..... D21F 5/00

[52] U.S. Cl. ..... 34/117; 34/119; 34/120

[58] Field of Search ..... 34/114, 115, 116, 34/117, 119, 120, 122, 124

[56] References Cited

U.S. PATENT DOCUMENTS

| | | | |
|---|---|---|---|
| 5,279,050 | 1/1994 | Törmänen | 34/117 |
| 5,537,755 | 7/1996 | Kotitschke | 34/117 |
| 5,560,123 | 10/1996 | Eskelinen | 34/117 X |
| 5,671,548 | 9/1997 | Blaschka et al. | 34/117 |
| 5,737,848 | 4/1998 | Chau-Huu et al. | 34/117 X |

FOREIGN PATENT DOCUMENTS

| | | |
|---|---|---|
| 19509581 | 9/1996 | Germany . |
| 1411778 | 10/1975 | United Kingdom . |
| 9425671 | 11/1994 | WIPO . |

OTHER PUBLICATIONS

German Search Report dated Apr. 21, 1997.

*Primary Examiner*—Henry Bennett
*Assistant Examiner*—Steve Gravini
*Attorney, Agent, or Firm*—Greenblum & Bernstein P.L.C.

[57] ABSTRACT

Machine for manufacturing a material sheet and method of guiding the material sheet through the machine. The machine may include a dryer section including at least one dryer group having a plurality of dryer cylinders. Centers of a first plurality of the plurality of dryer cylinders may be arranged on an upper level and centers of a second plurality of the plurality of dryer cylinders may be arranged on a lower level spaced a distance from the upper level. A top felt may be associated with at least one of the first plurality of dryer cylinders and a bottom felt associated with at least one of the second plurality of dryer cylinders. The machine may also include a meandering run path for the material sheet through the at least one dryer group, the material sheet being guided in the meandering run path by the top and bottom felts, and at least one transition area between the plurality of dryer cylinders. The top and bottom felts may be positioned to guide the material sheet therebetween in the at least one transition area between the dryer cylinders.

19 Claims, 2 Drawing Sheets

MACHINE FOR MANUFACTURING A MATERIAL SHEET

CROSS-REFERENCE TO RELATED APPLICATION

The present application claims priority under 35 U.S.C. § 119 of German Patent Application No. 196 41 599.3 filed Oct. 9, 1996.

BACKGROUND OF THE INVENTION

1. Field of the Invention

The present invention relates to a machine for manufacturing a material sheet, e.g., a paper or cardboard sheet. The machine may include with a dryer section having at least one dryer group with a plurality of dryer cylinders. The plurality of dryer cylinders may be positioned such that the centers of a first plurality dryer cylinders are arranged on an upper level and that the centers of a second plurality of dryer cylinders are arranged on a lower level spaced a distance from the upper level. The machine may also include a top felt assigned to at least one of the dryer cylinders of the upper level and a bottom felt assigned to at least one of the dryer cylinders of the lower level to guide the material sheet along a meandering (or winding) run through the dryer group. The material sheet may be guided between the top felt and the bottom felt in at least one transition area located between the dryer cylinders.

2. Discussion of Background Information

Machines similar in general to the type described above are known in the art, however, these machines consist of dryer sections with at least one dryer group with a number of dryer cylinders positioned on two levels spaced at a distance from each other. Dryer groups of this type are commonly referred to as double-row dryer groups. A felt for guiding the material sheet is assigned to each of the top and the bottom cylinder rows. The material sheet runs through the dryer group alternatingly, i.e., the sheet is alternately guided around a dryer cylinder of the upper row and a dryer cylinder of the bottom row. The material sheet runs through a free stretch between the dryer cylinders, i.e., in which the sheet is not guided the felt belts. A disadvantage of this arrangement is that the material sheet can shrink freely when in the free stretches. Further, because shrinkage on the sheet edges is greater than in the middle of the sheet, this shrinkage results in a material sheet that exhibits different characteristics across its width.

SUMMARY OF THE INVENTION

The present invention provides a machine for manufacturing a material sheet that does not exhibit the above-noted disadvantages of the prior art.

The present invention provides certain advantages over the prior art in that the machine includes a dryer section having at least one dryer group with a plurality of dryer cylinders. The plurality of dryer cylinders may be positioned such that the centers of a first plurality dryer cylinders are arranged on an upper level and that the centers of a second plurality of dryer cylinders are arranged on a lower level spaced a distance from the upper level. The machine may also include a top felt assigned to at least one of the dryer cylinders of the upper level and one bottom felt assigned to at least one of the dryer cylinders of the lower level to guide the material sheet along a meandering (or winding) run through the dryer group. The material sheet may be guided between the top felt and the bottom felt in at least one transition area located between the dryer cylinders. By guiding the material sheet through the at least one transition area between the upper felt and the lower felt, shrinkage of the material sheet may be restricted or substantially reduced. In this manner, the material sheet may be substantially clamped down and secured by the two felts to extend at least across a width of the material sheet. Thus, even shrinkage of the material sheet may be ensured. The at least one transition area may be positioned between dryer cylinders located on a same level or may be positioned dryer cylinders located on different levels. By locking or clamping the material sheet in position in an area of free stretches, uniform characteristics may result across an entire sheet width, thus, improving the material sheet quality.

According to a particularly preferred embodiment of the present invention, the material sheet may be guided between two dryer cylinders of one or a same level by being guided round at least two guide rolls positioned at a spaced distance from each other. In this manner, the material sheet guided between the at least two guide rolls may preferably extend parallel the dryer cylinder levels. The felt belt assigned or associated with the dryer cylinders of the other level may also be guided over these guide rolls. The level on which the guide rolls are arranged may be located between the two levels on which the dryer cylinders are arranged. If the guide rolls are, e.g., assigned to or associated with dryer cylinders of the lower level, the top felt assigned to or associated with the dryer cylinders of the upper level may be guided so that the material sheet being fed over the guide rolls is positioned between the bottom felt, which is in contact with the guide rolls, and the top felt. The material sheet may be clamped down by the felt to prevent a free shrinkage of the sheet. If the two guide rolls are assigned to or associated with the dryer cylinders of the upper level, the bottom felt may be guided so that the material sheet is held in place between the top and bottom felts and the top felt is in contact with the guide rolls.

Further, in another preferred embodiment of the machine, the material sheet in the area between the two guide rolls may be exposed to air, and preferably hot air. Available empty space between the dryer cylinders may be utilized for increasing the drying capacity of the dryer section. The moisture removal, which may be increased by the additional drying, may take place in an area in which the material sheet is clamped in place between the top and the bottom felt and, thus, is unable to shrink freely.

Accordingly, the present invention is directed to a machine for manufacturing a material sheet. The machine may include a dryer section including at least one dryer group having a plurality of dryer cylinders. Centers of a first plurality of the plurality of dryer cylinders may be arranged on an upper level and centers of a second plurality of the plurality of dryer cylinders may be arranged on a lower level spaced a distance from the upper level. A top felt may be associated with at least one of the first plurality of dryer cylinders and a bottom felt associated with at least one of the second plurality of dryer cylinders. The machine may also include a meandering run path for the material sheet through the at least one dryer group, the material sheet being guided in the meandering run path by the top and bottom felts, and at least one transition area between the plurality of dryer cylinders. The top and bottom felts may be positioned to guide the material sheet therebetween in the at least one transition area between the dryer cylinders.

In accordance with another feature of the present invention, the machine may also include at least two guide rolls located between two dryer cylinders of a same level.

The meandering run path may include a path in which the material sheet is guided over the at least two guide rolls and the felt associated with the other level may be also guided over the at least two guide rolls.

In accordance with another feature of the present invention, the machine may include at least one of a suction and blow box positioned between the two dryer cylinders of the same row level to produce a partial vacuum in the vicinity of the at least two guide rolls.

In accordance with still another feature of the present invention, the machine may include an air source to expose the material sheet to air in a vicinity between the two guide rolls. Further, the air source may be a hot air source.

In accordance with a further feature of the present invention, the meandering run path may include a path in which the material sheet may be alternatingly guided around two dryer cylinders of a same level and subsequently guided around two dryer cylinders of the other level.

In accordance with a still further feature of the present invention, the machine may also include a sheet guide device to stabilize the material sheet in the at least one transition area. The at least one transition area may be located between the dryer cylinders of the upper level and the dryer cylinders of the lower level. Further, the sheet guide device may include at least one of a suction and blow-box.

In accordance with a still further feature of the present invention, the material sheet may include one of a paper and a cardboard sheet.

The present invention is also directed to a dryer group for a material sheet producing machine. The dryer group may include a plurality of dryer cylinders forming a first row, a plurality of dryer cylinders forming a second row, and a transition area located between the first and second row. The dryer group may also include a first transport belt associated with the first row and a second transport belt associated with the second row. The first and second transport belts may be positioned to be guided together through at least a portion of the transition area.

In accordance with another feature of the present invention, the dryer group may include a transfer device positioned between adjacent dryer cylinders in the first row and extending into the transition area.

In accordance with another feature of the present invention, the first and second transport belts may be concurrently guided over the transfer device.

In accordance with still another feature of the present invention, the transfer device may include at least two guide rolls guiding the first and second transport belts and at least one of a suction and blow box producing a partial vacuum between the at least two guide rolls. Further, a suction/blow box may be positioned within the transition area, adjacent to one of the first and second transport belts, and opposite the transfer device. The suction/blow box may be positioned to blow air through the first and second transport belts, and the blown air may be removed by the transfer device. Alternatively, the suction/blow box may be positioned to create a suction on a surface of the adjacent one of the first and second transport belt opposite the surface adapted to guide the sheet material.

In accordance with a further feature of the present invention, the dryer group may include a sheet guide device positioned within the transition area and adjacent to one of the first and second transport belts. Further, the sheet guide device may be positioned adjacent a surface of the one of the first and second transport belt opposite the surface adapted to guide the material sheet.

In accordance with still another feature of the present invention, the first and second transport belts may be positioned to guide the material sheet through the dryer group along a path in which the material sheet is alternating guided around adjacent dryer cylinders of the first row and around adjacent dryer cylinders of the second row.

In accordance with another feature of the present invention, the dryer group may include a second transfer device positioned between adjacent dryer cylinders in the second row and extending into the transition area.

The present invention is directed to a method for guiding a material sheet through a multiple dryer cylinder two-row dryer group in a material sheet producing machine. The method may include guiding the material sheet over at least two adjacent dryer cylinders in a first dryer row of the two-row dryer group, guiding the material sheet over at least two adjacent dryer cylinders in a second dryer row of the two-row dryer group, and guiding the material sheet between a first and second transport belt within a transition area between the first and second row.

In accordance with yet another feature of the present invention, the method may include exerting air through the first and second transport belt within the transition area. Further, the method may include wrapping the material sheet around more than approximately 180° of a circumference of the dryer cylinders, and preferably around approximately 235° of the dryer cylinder circumference.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The machine described herein may be universally utilized. Thus, while the disclosure discusses certain exemplary embodiments related to the manufacture of a paper sheet, the present invention is equally applicable and advantageous in the production of material sheets or webs or other similar products.

Figure 1:
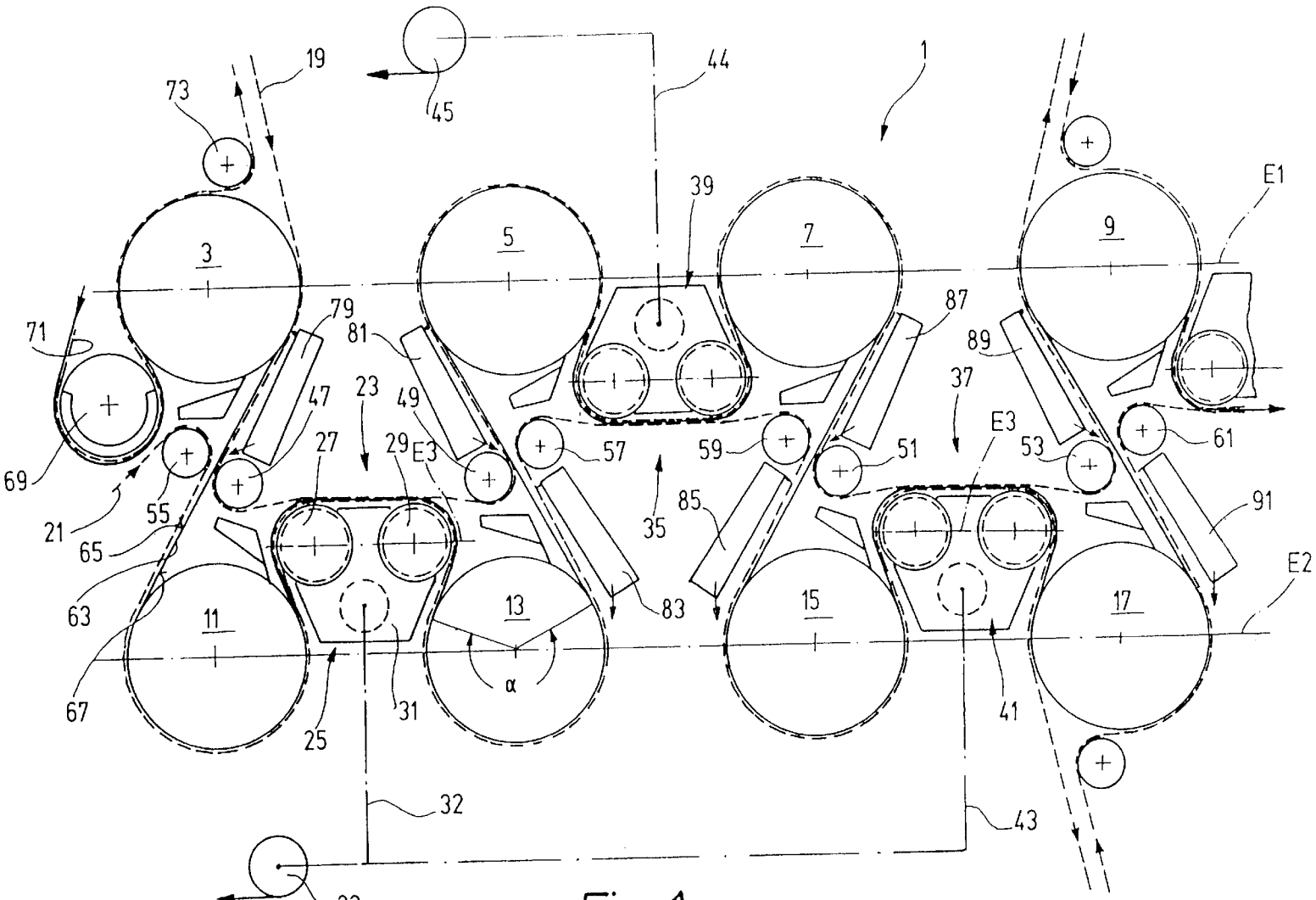
FIG. 1 illustrates a schematic side view of a double-row dryer group of a dryer section.

FIG. 1 illustrates a schematic view of a dryer group 1 within a dryer section of a paper manufacturing machine.

Dryer group 1 may include a plurality of dryer cylinders 3, 5, 7, and 9, whose centers are positioned along a first (upper) level or row E1, and dryer cylinders 11, 13, 15, and 17, whose centers are positioned along a second (lower) level E2. Level E2 may be positioned at a distance below, and extend parallel to, level or row E1. A felt 19 may be assigned to or associated with dryer cylinders 3, 5, 7, and 9 of upper level E1. Felt 19 may be more commonly known as a top felt, a transport belt, a dryer screen or felt, or a screen belt. A felt 21 may be assigned to or associated with the dryer cylinders 11, 13, 15, and 17 of lower level E2. Felt 21 may be more commonly known as a bottom felt. As shown in the figure, the distance of dryer cylinders 3 to 9 is substantially equal to the distance of dryer cylinders 11 to 17. Further, dryer cylinders pairs 3 and 11, 5 and 13, 7 and 15, and 9 and 17 may be positioned so that in an imaginary line extending through the centers of each dryer cylinder pair is substantially perpendicular to the upper and lower levels E1 and E2.

A transfer device 25 may be provided in a transition area 23 between dryer cylinder 11 and the dryer cylinder 13 of the bottom row. Transfer device 25 may include at least two guide rolls 27 and 29 that may have perforated sleeve surfaces. The centers of guide rolls 27 and 29 may be arranged along a level E3, which may be positioned between and substantially parallel to, levels or rows E1 and E2. The distance between level E3 and level E2 may be less than the distance between level E3 and level E1. A suction box 31 may be assigned to or associated with guide rolls 27 and 29 and may be coupled to a vacuum source, e.g., a vacuum blower 33, via a line 32 (represented by a broken line). Transfer devices 39 and 41, which are substantially identical to transfer device 25, in transition area 35, located between dryer cylinders 5 and 7, and may be provided in transition area 37, located between dryer cylinders 15 and 17, respectively. Transfer device 41 may be coupled to suction blower 33 via a separate line 43 (also represented as a broken line). Transfer device 39 may be coupled to a separate suction blower 45 via a line 44. Alternatively, it is noted that the present invention contemplates that all transfer devices may be coupled to a single suction blower, e.g., suction blower 33. The vacuum created by the suction blowers in the transfer devices may be deflected onto the felt so that the material sheet is held onto the felt, e.g., via the perforated or grooved sleeve surfaces of the guide rolls, and stabilized.

Top felt 19 may be additionally guided with the aid of deflection rolls, of which deflection rolls 47, 49, 51, and 53 are illustrated in FIG. 1. In this manner, top felt 19 may be looped partially around dryer cylinders 3, 5, 7, and 9 and partially around the guide rolls of transfer device 39 within transition area 35. In transition areas 23 and 37, top felt 19 may be guided via transfer devices 25 and 41 between deflection rolls 47 and 49 and deflection rolls 51 and 53, respectively. Bottom felt 21 may be guided partially around dryer cylinders 11, 13, 15, and 17, partially around the guide rolls of transfer devices 25 and 41, and partially around a plurality of deflection rolls, of which deflection rolls 55, 57, 59, and 61 are illustrated. The bottom felt may also be guided over transfer device 39 between deflection rolls 57 and 59.

Material sheet 63, e.g., a paper or cardboard sheet, may enter dryer group 1 with its bottom side or surface 65 on, or in contact with, an outer surface of dryer cylinders 3, 5, 7, and 9 forming upper level E1, and with its top side or surface 67 on, or in contact with, dryer cylinders 11, 13, 15, and 17 forming lower level E2. Sheet 63 may exhibit uniform characteristics on its bottom and top sides due to its passage through the two-sided dryer.

Sheet 65 may be guided between a deflection suction roll 69 and a transport belt 71 onto dryer cylinder 3 of dryer group 1. While transport belt 71 may be guided, e.g., back to beginning of a preceding dryer group by deflection roll 73, material sheet 63 may remain on dryer cylinder 3 and may be held against the surface of dryer cylinder 3 via top felt 19. Material sheet 63, supported by top felt 19, may be transferred to bottom felt 21 at approximately a middle of a transition area between dryer cylinder 3 and dryer cylinder 11 to guide material sheet 63 into lower level E2 of dryer group 1. As shown in FIG. 1, top felt 19 and bottom felt 21 may be guided into each transition area between upper level E1 and lower level E2 so that free stretches may be avoided. To avoid free stretches, deflection rolls 55 and 47, 49 and 57, 59 and 51, and 53 and 61 may each be positioned opposite each other on opposite sides of material sheet 63. The distance between the deflection rolls, arranged in pairs, may be preferably selected or determined depending on a moisture content of material sheet 63. Thus, a distance between deflection rolls 55 and 47, located at a beginning of dryer section 1, may be less than a distance between deflection rolls 53 and 61, located at an end of dryer group 1, since the moisture content of material sheet 63 at the beginning of dryer group 1 is higher than at the end. While the moisture content is high, there is a danger of tearing that is greater than with a low moisture content as is exhibited at the end of dryer group 1. Further, a longitudinal stretch of material sheet 63 may be provided by increasing a distance between the deflection rolls, i.e., the arranged pairs, toward the end of dryer section 1.

Material sheet 63 may be guided around transfer device 25 associated with the dryer cylinders of lower level E2 in such a manner that material sheet 63 may be positioned and substantially clamped down between bottom felt 21, which lies on transfer device 25, or more particularly, on guide rolls 27 and 29, and top felt 19, which may be guided over transfer device 25 via deflection rolls 47 and 49. Thus, material sheet 63 may be guided around adjacent dryer cylinders in a same dryer cylinder row, e.g., dryer cylinders 11 and 13, before extending through the transition area and around the next roll in the other dryer cylinder row, e.g., dryer cylinder 5. Material sheet 63 is thus clamped down between top and bottom felts 19 and 21 extending in the same direction. In this manner, free shrinkage of sheet 63, particularly in a direction transverse to the movement direction, i.e. across the sheet width, may be substantially prevented. Thus, sheet 63, when viewed in the direction transverse to the movement direction, exhibits uniform characteristics. In a similar manner, material sheet 63 may be clamped between top felt 19 and bottom felt 21, while being guided around transfer device 39 and transfer device 41, thus, achieving the aforementioned advantages.

Further, sheet guide devices 79, 81, 83, 85, 87, 89, and 91, which may be, e.g., preferably provided as suction/blow boxes, may be positioned in the transition area between upper level E1 and lower level E2. Sheet guide devices 79, 81, 83, 85, 87, 89, and 91, sometimes referred to as sheet stabilizers, may be utilized to hold material sheet 63 onto top or bottom felt 19 and 21, respectively. By maintaining the contact of the material sheet 63 to the respective felt belt, sheet shrinkage in the direction transverse to the movement direction may be substantially prevented.

A surface area of the dryer cylinders surrounded by material sheet 63 may be larger than that available in conventional dryer sections. For example, as shown in FIG. 1, a looping angle $\alpha$ around dryer cylinder 13 may be approximately 235°. In a similar manner, a correspondingly greater surface area of dryer cylinders 3, 5, 7, 9, 11, 15, and 17 of which material sheet 63 makes a surface contact for drying may be achieved. Dryer group 1 may be distinguished from the devices of the prior art by its high specific dryer capacity, i.e. the dryer rate relative to a construction length of the dryer group is higher than that available in the prior art.

Figure 2:
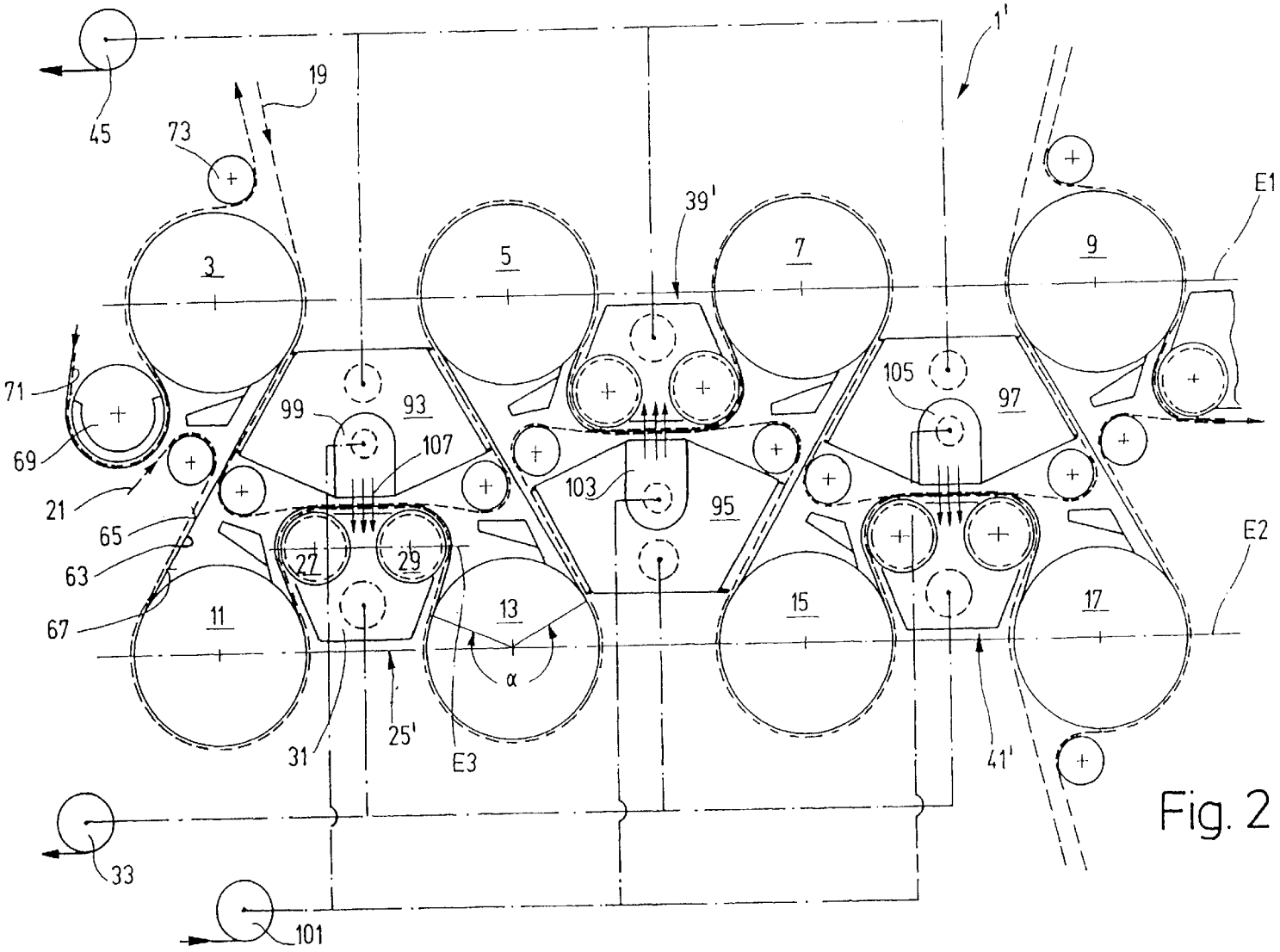
FIG. 2 illustrates another embodiment of the dryer section depicted in FIG. 1.

FIG. 2 shows an alternative embodiment of the dryer group depicted in FIG. 1. Thus, elements that correspond with those illustrated in FIG. 1 are referenced with same reference symbols. Thus, a full explanation of these elements may be found in the description of FIG. 1.

FIG. 2 illustrates dryer group 1', which may include transfer devices 25', 39', and 41'. Transfer devices 25', 39', and 41' may be constructed in a substantially similar manner as transfer devices 25, 39, and 41 of FIG. 1, however, transfer devices 25', 39' and 41' may differ from those depicted in FIG. 1 in the manner described herein below. The area between guide rolls 27 and 29 of transfer device 25' in which material sheet 63 is clamped between top felt 19 and bottom felt 21 may be put under a partial vacuum.

Thus, in place of the sheet guide devices of FIG. 1, suction/blow boxes 93, 95, and 97 may be arranged in the transition area between upper level E1 and lower level E2 of dryer group 1'. To create the partial vacuum, suction boxes may be coupled to suction blower 33 or 45 via lines (shown by broken lines). Suction/blow boxes 93, 95, and 97 may also stabilize material sheet 63 as it passes through the transition areas between the dryer cylinder rows. Suction/blow boxes 93, 95, and 97 may be substantially identical and may be oriented in a substantially similar manner with respect to the opposing guide devices.

Blow box 99 of suction/blow box 93 may be coupled with a blower 101 for supplying air, and preferably hot air, via a line (shown in broken lines). Blower 101 may also supplies blow boxes 103 and 105 of suction boxes 95 and 97 with hot air. Blow box 99, arranged within suction/blow box 93 may be positioned opposite transfer device 25' to expose material sheet 63 to a hot air stream (indicated by arrows 107). Hot air stream 107 may penetrate top felt 19, material sheet 63, and bottom felt 21 and be suctioned in transfer device 25' by suction box 31. In this manner, moisture may be extracted from material sheet 63. Further, because of the additional air-drying, the moisture removal of material sheet 63 may be increased and the drying capacity of dryer group 1' may be improved. The above-mentioned devices for providing the additional air-drying of material sheet 63 may be implemented in areas of dryer section 1' in which material sheet 63 exhibits a required porosity. In substantially all other respects, dryer group 1' exhibits all the advantages of the dryer group 1 described in FIG. 1.

Thus, in accordance with the above-discussed features of the present invention, free shrinkage of the material sheet may be prevented by clamping the material sheet 63 between top felt 19 and bottom felt 21 in a transition area between two dryer cylinders, and by avoiding free stretches in the transition areas between the upper level dryer cylinder row and the lower level dryer cylinder row. The resultant material sheet thereby exhibits uniform characteristics across its width and, therefore, is of a high quality. Further, the present invention provides an enlarged circumferential contact area of the material sheet against the dryer cylinders. In this manner, the construction of the dryer section of the present invention is very compact relative to known dryer sections with a comparable drying rate. Thus, sheet manufacturing costs may be substantially reduced.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A machine for manufacturing a material sheet comprising:

a dryer section including at least one dryer group having a plurality of dryer cylinders;

centers of a first plurality of the plurality of dryer cylinders arranged on an upper level and centers of a second plurality of the plurality of dryer cylinders arranged on a lower level spaced a distance from the upper level;

a top felt associated with at least one of the first plurality of dryer cylinders;

a bottom felt associated with at least one of the second plurality of dryer cylinders;

a meandering run path for the material sheet through the at least one dryer group, the material sheet guided in the meandering run path by the top and bottom felts;

at least two guide rolls located between two dryer cylinders of a same level;

at least one transition area between the plurality of dryer cylinders; and the top and bottom felt positioned to guide the material sheet therebetween in the at least one transition area between the dryer cylinders.

2. The machine in accordance with claim 1, the meandering run path comprising a path in which the material sheet is guided over the at least two guide rolls; and the felt associated with the other level is also guided over the at least two guide rolls.

3. The machine in accordance with claim 2, further comprising at least one of a suction and blow box positioned between the two dryer cylinders of the same row level to produce a partial vacuum in the vicinity of the at least two guide rolls.

4. The machine in accordance with claim 2, further comprising an air source to expose the material sheet to air in a vicinity between the two guide rolls.

5. The machine in accordance with claim 4, the air source being a hot air source.

6. The machine in accordance with claim 1, the meandering run path comprising a path in which the material sheet is alternatingly guided around two dryer cylinders of a same level and subsequently guided around two dryer cylinders of the other level.

7. The machine in accordance with claim 1, further comprising a sheet guide device to stabilize the material sheet in the at least one transition area; and the at least one transition area being located between the dryer cylinders of the upper level and the dryer cylinders of the lower level.

8. The machine in accordance with claim 7, the sheet guide device comprising at least one of a suction box and blow-box.

9. The machine in accordance with claim 8, the sheet guide device comprising a blower.

10. The machine in accordance with claim 1, the material sheet comprising one of a paper and a cardboard sheet.

11. A dryer group for a material sheet producing machine comprising:

a plurality of dryer cylinders forming a first row;

a plurality of dryer cylinders forming a second row;

a transition area located between the first and second row;

a first transport belt associated with the first row;

a second transport belt associated with the second row;

a transfer device positioned between adjacent dryer cylinders in the first row and extending into the transition area, the transfer device comprising at least two guide rolls guiding the first transport belt and the second transport belt, at least one of a suction box and blow box producing a partial vacuum between the at least two guide rolls; and the first and second transport belts being positioned to be guided together through at least a portion of the transition area.

12. The dryer group in accordance with claim 11, the first and second transport belts being concurrently guided over the transfer device.

13. The dryer group in accordance with claim 11, further comprising:

a suction/blow box positioned within the transition area, adjacent to one of the first and second transport belts, and opposite the transfer device.

14. The dryer group in accordance with claim 13, the suction/blow box positioned to blow air through the first and second transport belts; and the blown air being removed by the transfer device.

15. The dryer group in accordance with claim 13, the suction/blow box positioned to create a suction on a surface of the adjacent one of the first and second transport belt opposite the surface adapted to guide the sheet material.

16. The dryer group in accordance with claim 11, further comprising:

a sheet guide device positioned within the transition area and adjacent to one of the first and second transport belts.

17. The dryer group in accordance with claim 16, the sheet guide device positioned adjacent a surface of the one of the first and second transport belt opposite the surface adapted to guide the material sheet.

18. The dryer group in accordance with claim 11, the first and second transport belts positioned to guide the material sheet through the dryer group along a path in which the material sheet is alternating guided around adjacent dryer cylinders of the first row and around adjacent dryer cylinders of the second row.

19. The dryer group in accordance with claim 11, further comprising a second transfer device positioned between adjacent dryer cylinders in the second row and extending into the transition area.

* * * * *